US005804787A

United States Patent [19]

Daimon et al.

[11] Patent Number: 5,804,787

[45] Date of Patent: Sep. 8, 1998

[54] GAS CIRCUIT BREAKER AND LIQUID PRESSURE-DRIVING SYSTEM TO BE USED THEREFOR

[75] Inventors: Goro Daimon; Yasuhide Takeda, both of Hitachi; Tadahiko Nogami, Mito; Hideo Kawamoto, Hitachi; Hiroshi Maeda, Hitachi; Kouichi Sadou, Hitachi; Hiroyoshi Sadamura, Jyuou-machi, all of Japan

[73] Assignee: Hitachi, Ltd., Tokyo, Japan

[21] Appl. No.: 746,571

[22] Filed: Nov. 13, 1996

[30] Foreign Application Priority Data

Nov. 20, 1995 [JP] Japan ..... 7-300935

[51] Int. Cl.[6] ..... H01H 35/38

[52] U.S. Cl. ..... 218/84; 200/82 B

[58] Field of Search ..... 91/23, 43–45, 91/433, 451, 452, 517, 518, 523; 218/7, 14, 43, 51, 56, 66, 78, 83, 86, 84, 88, 120, 140, 153, 154; 200/82 B

[56] References Cited

U.S. PATENT DOCUMENTS 3,832,502 8/1974 Grieger et al. ..... 200/82 B
3,969,985 7/1976 Grieger et al. ..... 91/416
4,404,892 9/1983 Nakamura et al. ..... 91/396
5,353,594 10/1994 Yamashita et al. ..... 60/413

FOREIGN PATENT DOCUMENTS 58-14636 7/1983 Japan .

*Primary Examiner*—Cassandra C. Spyrou
*Assistant Examiner*—Michael A. Friedhofer
*Attorney, Agent, or Firm*—Fay, Sharpe, Beall, Fagan, Minnich & McKee

[57] ABSTRACT

For the purpose of providing a gas circuit breaker with a structure of hydraulic pressure operation system capable of detecting the occurrence of an incomplete closed state of the valves therein to prevent their erroneous motion during the subsequent motion, and a liquid-pressure driving system to be used therefor, a check valve is arranged so as to suppress the flow into the space on the side of the downstream of a closed-circuit operation spool valve, wherein the space on the side of the downstream of the closed-circuit operation spool valve is connected through a second diaphragm to a low-pressure oil tank and the operation time or operation number of a liquid-pressure pump is measured.

10 Claims, 7 Drawing Sheets

CLOSED-CIRCUIT STATE

ON THE WAY OF CIRCUIT OPENING
1
2
3
4
5
6
10
11
12
20
21
22
23
24
25
30
31
33
34
35
36
40
41
50
51
60
61
63
64
65
70
71
80
81
90

OPEN-CIRCUIT STATE

ON THE WAY OF CIRCUIT CLOSING

MOTION WITH PRIORITY GIVEN TO CIRCUIT OPENING

FIG. 7

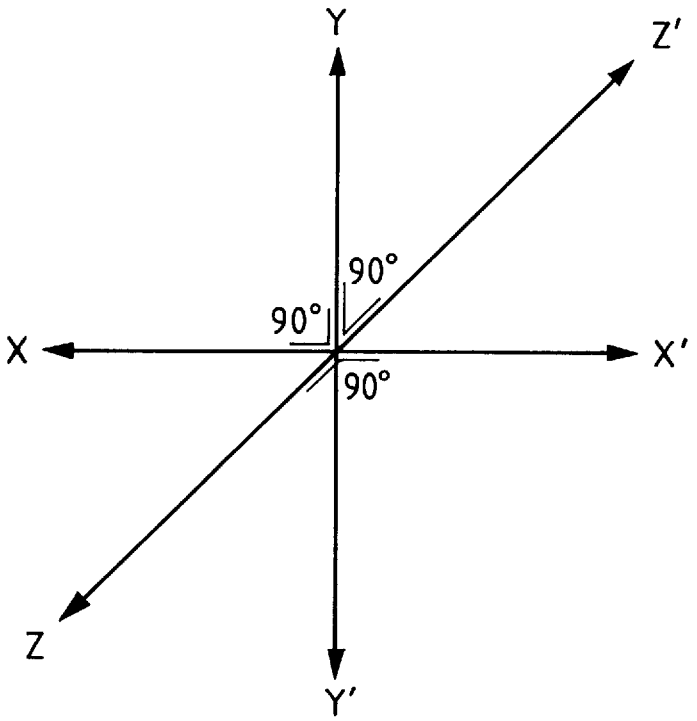

DIRECTION OF X-X' AXIS — DIRECTION OF MOTION OF LIQUID-PRESSURE CYLINDER

DIRECTION OF Y-Y' AXIS — DIRECTION OF MOTION OF CLOSED-CIRCUIT PILOT VALVE DRIVING MECHANISM, CLOSED-CIRCUIT PILOT VALVE AND CLOSED-CIRCUIT OPERATION VALVE

DIRECTION OF MOTION OF OPEN-CIRCUIT PILOT VALVE DRIVING MECHANISM, OPEN-CIRCUIT PILOT VALVE AND OPEN-CIRCUIT OPERATION VALVE

DIRECTION OF Z-Z' AXIS — DIRECTION OF MOTION OF PRIMARY VALVE

GAS CIRCUIT BREAKER AND LIQUID PRESSURE-DRIVING SYSTEM TO BE USED THEREFOR

BACKGROUND OF THE INVENTION

The present invention relates to a gas circuit breaker and a liquid pressure-driving system to be used therefor. More specifically, the present invention relates to a gas circuit breaker having preferable functions such as the detection of oil leakage in the inside of valves and the protection of the loss of hydraulic pressure even if oil leakage occurs in the inside of valves, and the invention also relates to a liquid pressure-driving system to be used therefor.

Toward power supply systems supporting our society with recent development in the instrumentation and information systems, greater reliability has been demanded. Circuit breakers composing power supply systems have principal roles in satisfying the demand. Particularly, high-capacity gas circuit breakers have been used in the lines above ultra-high pressures, and hydraulic-pressure operation systems have primarily been used in the driving systems therefor. When a line should be switched and charged due to the occurrence of a short-circuit event in a line or for line switching or due to other reasons, it is required for these circuit breakers to have functions to break and charge the circuit on the basis of command. For power supply systems to attain higher reliability, in particular, circuit breakers should never fail to break the circuit on the basis of command when the breakers are at the state of closed circuit; and circuit breakers should have a highly reliable function to prevent pumping with priority given to tripping (namely, priority given to break).

Conventional liquid-pressure driving systems for gas circuit breakers, as described in Japanese Utility Model Laid-open No. Sho 58-14636, are exemplified as a liquid-pressure driving system using an open-circuit ball valve and a closed-circuit ball valve to switch the passage of a hydraulic pressure circuit to break and charge a circuit breaker.

So as to secure reliability, the conventional art described in the Utility Model Laid-open No. Sho 58-14636 provides measures such as the increase of the reliability of individual valves and the enhancement of the control of working fluid, but the art has the following disadvantageous factors from the respect of the construction of the liquid-pressure driving system used in the art.

When a closed-circuit ball valve is fixed at the closed-circuit state of a circuit breaker to cause an incomplete closed state, such incomplete closed state cannot be detected at the charged state. Therefore, the circuit breaker once opens even at such incomplete closed state when a circuit opening operation is conducted, but if the open-circuit ball valve is resumed, a charging operation again occurs to induce a pumping action. When an open-circuit operation valve is fixed at an open-circuit state of the circuit breaker to cause an incomplete closed state, this incomplete closed state cannot be detected at such open-circuit state. Thus, a circuit breaker once closes its circuit if a circuit closing operation is done at that state. However, (1) if the leakage is severe, the circuit again opens when the closed-circuit ball valve is resumed. If the command to open the circuit breaker continues, then, charging is again resumed to induce a pumping operation. (2) If the leakage is mild, no circuit opening motion is induced; and if the leakage level is above the discharge level of a liquid-pressure pump, the liquid pressure is lost while the breaker remains at the closed state, so that a circuit opening motion fails, disadvantageously.

SUMMARY OF THE INVENTION

It is a first object of the present invention to provide a gas circuit breaker with a structure of hydraulic pressure operation system capable of detecting the occurrence of such an incomplete closed state of the valve as described above to prevent erroneous motion during the subsequent motion, and to provide a liquid-pressure driving system to be used therefor.

It is a second object of the present invention to provide a gas circuit breaker to retain the hydraulic pressure at its closed state even if an incomplete closed state of the valve occurs, whereby the breaker can effect the subsequent circuit opening motion, and a liquid-pressure driving system to be used therefor.

It is a third object of the present invention to provide a gas circuit breaker capable of preventing erroneous motion of each valve while avoiding the mutual influence of mechanical vibration as much as possible, and a liquid-pressure driving system to be used therefor.

It is a fourth object of the present invention to provide a gas circuit breaker to avoid the occurrence of an incomplete closed state of any valve as much as possible, and a liquid-pressure driving system to be used therefor.

So as to attain the first object, the gas circuit breaker of the present invention has a construction such that a check valve is arranged so as to suppress the flow into the space on the side of the downstream of a circuit closing operation spool valve, wherein the space on the side of the downstream of the circuit closing operation spool valve is connected through a second diaphragm to a low-pressure oil tank and the operation time or operation number of a liquid-pressure pump is measured.

So as to attain the second object, the gas circuit breaker of the present invention is characterized in that a pilot valve driving system is equipped with a closed-circuit pilot valve driving mechanism to be actuated on the basis of a circuit closing command from a control system, a closed-circuit pilot valve to be opened and closed by means of the closed-circuit pilot valve driving mechanism, a closed-circuit operation first pilot chamber to be switched from a low pressure to a high pressure through the actuation of the closed-circuit pilot valve, and a closed-circuit operation valve to be driven by pressure switching in the closed-circuit operation first pilot chamber, and the pilot valve driving system is also equipped with an open-circuit pilot valve driving mechanism to be actuated on the basis of a circuit opening command from a control system, an open-circuit pilot valve to be opened and closed by means of the open-circuit pilot valve driving mechanism, an open-circuit operation first pilot chamber to be switched from a low pressure to a high pressure through the actuation of the open-circuit pilot valve, and an open-circuit operation valve to be driven by pressure switching in the open-circuit operation first pilot chamber, wherein the close-circuit operation first pilot chamber is connected through a first diaphragm to an accumulator and the side of the downstream of the closed-circuit operation valve is connected through a second diaphragm to a low-pressure oil tank and wherein the first and second diaphragms are set so that the sum of the flow through the first diaphragm and the flow through the second diaphragm might be smaller than the discharge level of the liquid-pressure pump.

Characteristically, the pilot valve driving system is equipped with a closed-circuit pilot valve driving mechanism to be actuated on the basis of a circuit closing command from a control system, a closed-circuit pilot valve to be opened and closed by means of the closed-circuit pilot valve driving mechanism, a closed-circuit operation first pilot chamber to be switched from a low pressure to a high pressure through the actuation of the closed-circuit pilot valve, and a closed-circuit operation valve to be driven by pressure switching in the closed-circuit operation first pilot chamber, and is also equipped with an open-circuit pilot valve driving mechanism to be actuated on the basis of a circuit opening command from a control system, an open-circuit pilot valve to be opened and closed by means of the open-circuit pilot valve driving mechanism, an open-circuit operation first pilot chamber to be switched from a low pressure to a high pressure through the actuation of the open-circuit pilot valve, and an open-circuit operation valve to be driven by pressure switching in the open-circuit operation first pilot chamber, wherein the closed-circuit operation first pilot chamber is connected through a first diaphragm to an accumulator and the side of the downstream of the closed-circuit operating valve is connected through a second diaphragm to a low-pressure oil tank and wherein the first and second diaphragms and the discharge level of the liquid-pressure pump are set so that a pressure above the certified lowest operation pressure of the circuit breaker might be maintained when the closed-circuit pilot valve and the closed-circuit operation valve are both at their open states.

Characteristically, the pilot valve driving system is equipped with a closed-circuit pilot valve driving mechanism to be actuated on the basis of a circuit closing command from a control system, a closed-circuit pilot valve to be opened and closed by means of the closed-circuit pilot valve driving mechanism, and a closed-circuit operation first pilot chamber to be switched from a low pressure to a high pressure through the actuation of the closed-circuit pilot valve, and is also equipped with an open-circuit pilot valve driving mechanism to be actuated on the basis of a circuit opening command from a control system, an open-circuit pilot valve to be opened and closed by means of the open-circuit pilot valve driving mechanism, an open-circuit operation first pilot chamber to be switched from a low pressure to a high pressure through the actuation of the open-circuit pilot valve, and an open-circuit operation valve to be driven by pressure switching in the open-circuit operation first pilot chamber, wherein the valve sheet dimensions of the closed-circuit pilot valve and the open-circuit pilot valve and those of the closed-circuit operation valve and the open-circuit operation valve are individually of identical dimensions; the closed-circuit operation first pilot chamber and the open-circuit operation first pilot chamber are connected through a first diaphragm and a third diaphragm, respectively, to a liquid-pressure source, and the side of the downstream of the closed-circuit operation valve is connected through a second diaphragm to a low-pressure oil tank and through the valve sheet of the open-circuit operation spool valve to the low-pressure oil tank, and the resistance of the passage including the first, second and third diaphragms between the liquid-pressure source to the low-pressure oil tank is set so that the pressure in the primary valve pilot chamber might position the primary valve for the circuit opening motion of the circuit breaker when the closed-circuit pilot valve, the closed-circuit operation valve, the open-circuit pilot valve and the open-circuit operation valve are all at their open states.

Characteristically, the primary valve is equipped with a closed-circuit valve of the primary valve, an open-circuit valve of the primary valve and a primary valve pilot chamber; the pilot valve driving system is equipped with a closed-circuit pilot valve driving mechanism to be actuated on the basis of a circuit closing command from a control system, a closed-circuit pilot valve to be opened and closed by means of the closed-circuit pilot valve driving mechanism, a closed-circuit operation first pilot chamber in communication with the closed-circuit pilot valve arranged therein, a closed-circuit operation valve, an open-circuit pilot valve driving mechanism to be actuated on the basis of a circuit opening command from a control system, an open-circuit pilot valve to be opened and closed by means of the open-circuit pilot valve driving mechanism, an open-circuit operation first pilot chamber in communication with the space with the open-circuit pilot valve arranged therein, and an open-circuit operation valve, wherein a liquid-pressure source is connected through one space of a liquid-pressure cylinder to the side of the closed-circuit valve of the primary valve; the space on the side of the closed-circuit valve of the primary valve is connected through a first diaphragm to the closed-circuit operation first pilot chamber; and the space on the side of the closed-circuit valve of the primary valve and the space of the closed-circuit operation valve spool, opposing to the closed-circuit operation first pilot chamber, are connected through a third diaphragm to the open-circuit operation first pilot chamber and the space of the open-circuit operation valve spool, opposing to the open-circuit operation first pilot chamber; the space on the side of the downstream of the closed-circuit operation valve and the space enclosed by the switching chamber of the liquid-pressure cylinder, the closed-circuit valve of the primary valve and the open-circuit valve of the primary valve are connected through a fourth diaphragm to the primary valve pilot chamber; the primary valve pilot chamber is connected through a check valve to the low-pressure oil tank; and the space on the side of the downstream of the open-circuit operation valve and the side of the downstream of the closed-circuit pilot and the open-circuit pilot valve are individually connected to the low-pressure oil tank.

The liquid-pressure driving system to be used in the gas circuit breaker is equipped with a liquid-pressure source comprising a liquid-pressure pump and an accumulator for pooling an operating liquid under pressure for supply, a liquid-pressure cylinder including a liquid-pressure piston, a primary valve equipped with a closed-circuit valve of the primary valve, an open-circuit valve of the primary valve and a primary valve pilot chamber, a closed-circuit pilot valve driving mechanism to be actuated on the basis of a circuit closing command from a control system, a closed-circuit pilot valve to be opened and closed by means of the closed-circuit pilot valve driving mechanism, a closed-circuit operation first pilot chamber in communication with the space with the closed-circuit pilot valve arranged therein, a closed-circuit operation valve, and an open-circuit pilot valve driving mechanism to be actuated on the basis of a circuit opening command from the control system, an open-circuit pilot valve to be opened and closed by means of the open-circuit pilot valve driving mechanism, an open-circuit operation first pilot chamber in communication with the space with the open-circuit pilot valve arranged therein, and a control valve system equipped with an open-circuit operation valve, wherein the liquid-pressure source is connected through one space of the liquid-pressure cylinder to the space on the side of the closed-circuit valve of the primary valve; the space on the side of the closed-circuit valve of the primary valve is connected through a first diaphragm to the closed-circuit operation first pilot chamber; the space on the side of the closed-circuit valve of the primary valve and the space of the closed-circuit operation spool valve, opposing to the closed-circuit operation first pilot chamber, are connected through a third diaphragm to the open-circuit operation first pilot chamber; the spaces described above are connected to the space of the open-circuit operation valve, opposing to the open-circuit operation first pilot chamber; the space on the side of the downstream of the closed-circuit operation valve, the space between the switching chamber of the liquid-pressure cylinder, the closed-circuit valve of the primary valve and the open-circuit valve of the primary valve, and the switching chamber of the liquid-pressure cylinder are connected through a fourth diaphragm to the primary valve pilot chamber; the space on the side of the downstream of the primary valve pilot chamber and the closed-circuit operation valve is connected through a check valve to the space on the side of the primary valve pilot chamber and the open-circuit operation valve; the space on the side of the downstream of the closed-circuit operation valve is connected through a second diaphragm to a low-pressure oil tank; the space on the side of the downstream of the open-circuit operation valve and the side of the downstream of the closed-circuit pilot valve and the open-circuit pilot valve are individually connected to the low-pressure oil tank, and wherein the liquid pressure of the switching chamber of the liquid-pressure cylinder is switched between a low pressure and a high pressure by switching the passage of the control valve system on the basis of a circuit closing command or a circuit opening command from the control system, to drive the liquid-pressure piston.

So as to attain the third object, the gas circuit breaker of the present invention is characterized in that the operation axis of the closed-circuit pilot valve and the closed-circuit operation valve of the pilot valve driving system and the operation axis of the open-circuit pilot valve and the open-circuit operation valve, and the operation axis of the primary valve of the control valve system are arranged in the vertical direction to the operation axis of a liquid-pressure piston in the liquid-pressure cylinder. Furthermore, the circuit breaker characteristically has an arrangement such that the operation axis of the liquid-pressure piston in the liquid-pressure cylinder, the operation axis of the primary valve of the control valve system, the operation axis of the closed-circuit operation valve, the closed-circuit operation valve, the open-circuit pilot valve and the open-circuit operation valve are vertical to each other.

So as to attain the fourth object, the gas circuit breaker of the present invention is characterized in that the pilot valve driving system is equipped with a closed-circuit pilot valve driving mechanism to be actuated on the basis of a circuit closing command from a control system, a closed-circuit pilot valve to be opened and closed by means of the closed-circuit pilot valve driving mechanism, a closed-circuit operation first pilot chamber to be switched from a low pressure to a high pressure through the actuation of the closed-circuit pilot valve, and a closed-circuit operation valve to be driven by pressure switching in the closed-circuit operation first pilot chamber, and is also equipped with an open-circuit pilot valve driving mechanism to be actuated on the basis of a circuit opening command from a control system, an open-circuit pilot valve to be opened and closed by means of the open-circuit pilot valve driving mechanism, an open-circuit operation first pilot chamber to be switched from a low pressure to a high pressure through the actuation of the open-circuit pilot valve, and an open-circuit operation valve to be driven by pressure switching in the open-circuit operation first pilot chamber, wherein the closed-circuit operation first pilot chamber and the open-circuit operation first pilot chamber are connected to an accumulator and the side of the downstream of the closed-circuit operating valve is connected through a check valve to the side of the upstream of the primary valve pilot chamber and the open-circuit operation valve.

Characteristically, the liquid-pressure driving system to be used in the gas circuit breaker is equipped with a liquid-pressure source comprising a liquid-pressure pump and an accumulator for pooling an operating liquid under pressure for supply, a liquid-pressure cylinder including a liquid-pressure piston, a control valve system including a primary valve to switch the liquid pressure of the switching chamber of the liquid-pressure cylinder between a low pressure and a high pressure to effect the driving operation of the liquid-pressure piston, an operation valve to switch the pressure of the primary valve pilot chamber between a low pressure and a high pressure to drive the primary valve, and a pilot valve controlling the operation valve, and a pilot valve driving system for switching the passage of the control valve system on the basis of the circuit opening or closing command from a control system, wherein the pilot valve driving system is equipped with a closed-circuit pilot valve driving mechanism to be actuated on the basis of a circuit closing command from the control system, a closed-circuit pilot valve to be opened and closed by means of the closed-circuit pilot valve driving mechanism, a closed-circuit operation first pilot chamber to be switched between a low pressure and a high pressure through the actuation of the closed-circuit pilot valve, and a closed-circuit operation valve to be driven by pressure switching of the closed-circuit first pilot chamber, and is also equipped with an open-circuit pilot valve driving mechanism to be actuated on the basis of a circuit opening command from the control system, an open-circuit pilot valve to be opened and closed by means of the open-circuit pilot valve driving mechanism, an open-circuit operation first pilot chamber to be switched between a low pressure and a high pressure through the actuation of the open-circuit pilot valve, and an open-circuit operation valve to be driven by pressure switching of the open-circuit first pilot chamber, and wherein the closed-circuit operation first pilot chamber and the open-circuit operation first pilot chamber are connected to an accumulator; the side of the downstream of the closed-circuit operation valve is connected through a check valve to the side of the upstream of the primary valve pilot chamber and the open-circuit operation valve; and the liquid-pressure piston is driven by switching the passage of the control valve system on the basis of a circuit opening or closing command from the control system thereby switching the liquid pressure in the switching chamber of the liquid-pressure cylinder between a low pressure and a high pressure.

BRIEF DESCRIPTION OF THE DRAWINGS

One example of the present invention will be described below with reference to FIGS. 1 to 5.

FIG. 7 is a view depicting one example of arranging the direction of the cylinder axis, the direction of the operation axis of the primary valve and other valves of a liquid-pressure driving system of a gas circuit breaker.

DESCRIPTION OF THE PREFERRED EMBODIMENTS

Figure 1:
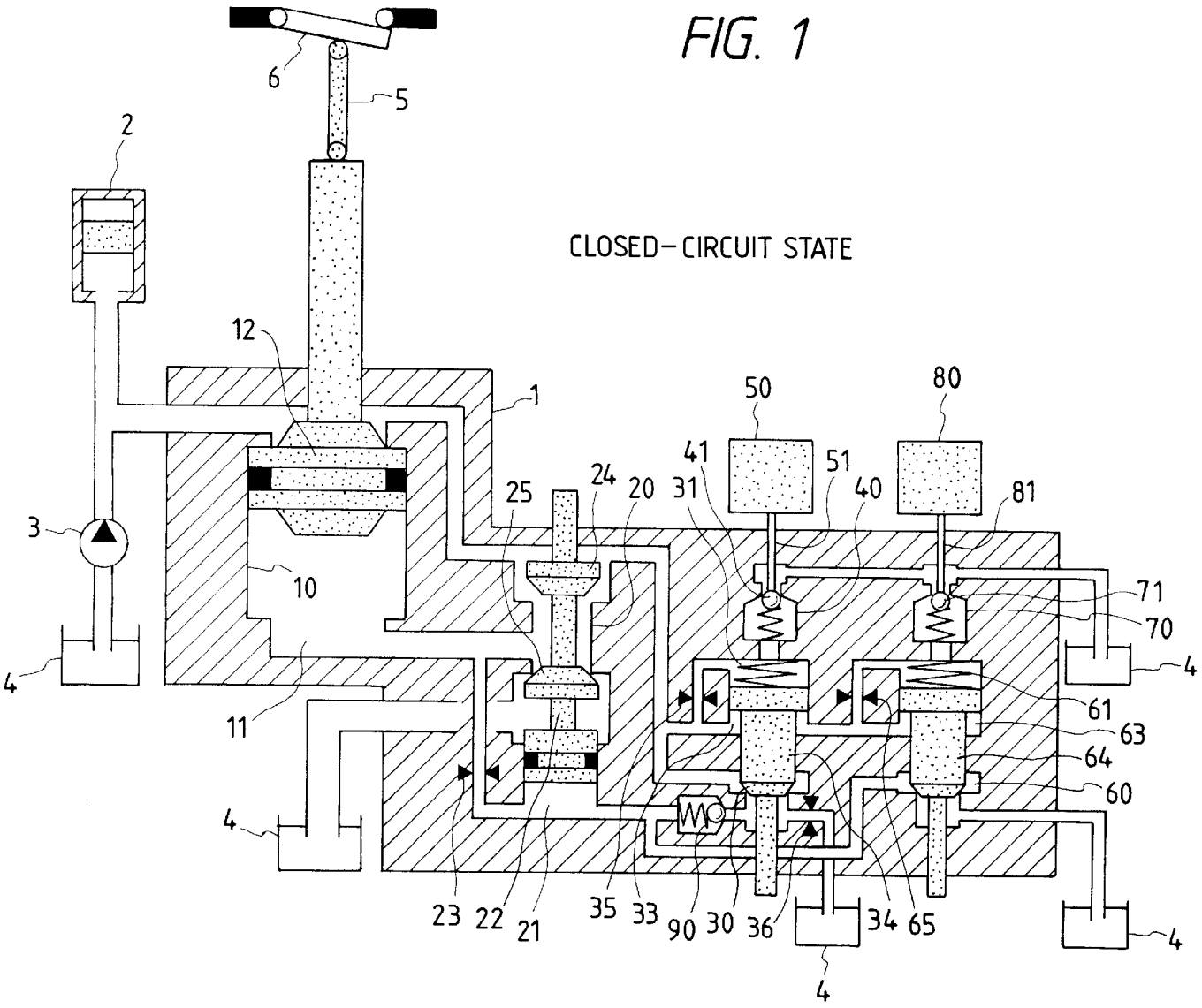
FIG. 1 is a longitudinal view depicting a liquid-pressure driving system of a gas circuit breaker at its closed state as one example of the present invention.

As shown in FIG. 1, the gas circuit breaker of the present invention primarily comprises liquid-pressure driving system 1 and circuit breaker 6 in connection through link mechanism 5 with the liquid-pressure driving system 1, wherein the circuit opening and closing motion is effected by driving the liquid-pressure driving system 1 on the basis of the operation command. Additionally, accumulator 2, liquid-pressure generating system 3 (referred to as "liquid-pressure pump 3" hereinafter), and low-pressure oil tank 4 are connected to the liquid-pressure driving system 1. A piston is arranged in the accumulator 2 for dividing the inside of the accumulator 2 into two spaces. One space thereof is sealed with for example nitrogen gas. The liquid-pressure driving system 1 is composed of main units such as liquid-pressure cylinder 10, primary valve 20, closed-circuit operation valve 30, closed-circuit pilot valve 40, closed-circuit pilot valve driving mechanism 50, open-circuit operation valve 60, open-circuit pilot valve 70, and open-circuit pilot valve driving mechanism 80.

In the liquid-pressure cylinder 10 is formed switching chamber 11 of the liquid-pressure cylinder, where liquid-pressure piston 12 to drive link mechanism 5 is arranged to induce reciprocating motion in the inside of the liquid-pressure cylinder 10. As shown in FIG. 1, the space of the liquid-pressure piston 12 on the side of the link mechanism 5 is connected, through a hydraulic pipe, in communication with the accumulator 2 and the liquid-pressure generating system 3; and the accumulator 2 reserves the oil from the low-pressure oil tank 4, after the pressure of the oil has been elevated by means of the liquid-pressure generating system 3. Herein, the liquid-pressure pump 3 is switched on and off at for example 320 $kg/cm^2G$ and 340 $kg/cm^2G$, respectively. The operation time or operation number of the liquid-pressure generating system 3 is measured and monitored by means of a control system not shown in the figure. The space of the liquid-pressure piston 12 on the side of the link mechanism 5 is also in communication with the space above valve 24 on the side of the closed-circuit valve of the primary valve 20 shown in FIG. 1. The switching chamber 11 of the liquid-pressure cylinder is in communication with the space enclosed by the valve 24 on the side of the closed-circuit valve of the primary valve and the valve 25 on the side of the open-circuit valve of the primary valve. Additionally, the switching chamber 11 is in communication through diaphragm 23 with primary valve pilot chamber 21 formed below primary valve spool 22. Further, the space of the primary valve spool 22 on the side of the downstream of the valve 25 on the side of the open-circuit valve of the primary valve is in communication with the low-pressure oil tank 4.

Still furthermore, the space above the valve 24 on the side of the closed-circuit valve of the primary valve is separately in communication with the space of closed-circuit operation valve first pilot chamber 31, closed-circuit operation valve second pilot chamber 33 and closed-circuit operation valve 30. The closed-circuit operation valve second pilot chamber 33 is by different routes in communication with open-circuit operation valve second pilot chamber 63, and in communication through diaphragm 65 with open-circuit operation valve first pilot chamber 61. Above the closed-circuit operation valve first pilot chamber 31 is arranged ball valve 41 of the closed-circuit pilot valve 40, while ball valve 71 of open-circuit pilot valve 70 is arranged above the open-circuit operation valve first pilot chamber 61. In communication with the low-pressure oil tank 4, passages are formed to be communicated and broken by means of the opening and closing motion of the ball valves 41 and 71 on the side of the pilot valve driving mechanisms of the ball valves 41 and 71.

Alternatively, primary valve pilot chamber 21 is in communication through check valve 90 with the space below the closed-circuit operation valve 30, and the space below the closed-circuit operation valve 30 is in communication, through diaphragm 36 by means of a passage divided upstream the check valve 90, with the low-pressure oil tank 4. The primary valve pilot chamber 21 is in communication with the space above the open-circuit operation valve 60 and is then in communication through the open-circuit operation valve 60 with the low-pressure oil tank 4.

Closed-circuit pilot valve driving mechanism 50 is arranged in the closed-circuit pilot valve 40, and the closed-circuit pilot valve driving mechanism 50 drives spool 51 downward on the input of a circuit closing command from a control system not shown in the figure, to open the ball valve 41 of the closed-circuit pilot valve 40. The closed-circuit pilot valve driving mechanism 50 is constructed so that the completion of the circuit closing operation of the circuit breaker resets electrically or mechanically the mechanism 50. Therefore, once reset, the spool 51 of the closed-circuit pilot valve driving system 50 resumes its position upward. Similarly, open-circuit pilot valve driving system 80 is arranged in open-circuit pilot valve 70, and on the input of the circuit opening command from a control system not shown in the figure, the open-circuit pilot valve driving mechanism 80 drives spool 81 downward to open ball valve 71 of open-circuit pilot valve 70. The open-circuit pilot valve driving mechanism 80 is constructed so that the mechanism is electrically or mechanically reset on the completion of circuit opening operation of the circuit breaker. Thus, once reset, the spool 81 of the open-circuit pilot valve driving mechanism 80 resumes its position upward.

The operation of the liquid-pressure driving system 1 thus constructed will now be described below.

Figure 2:
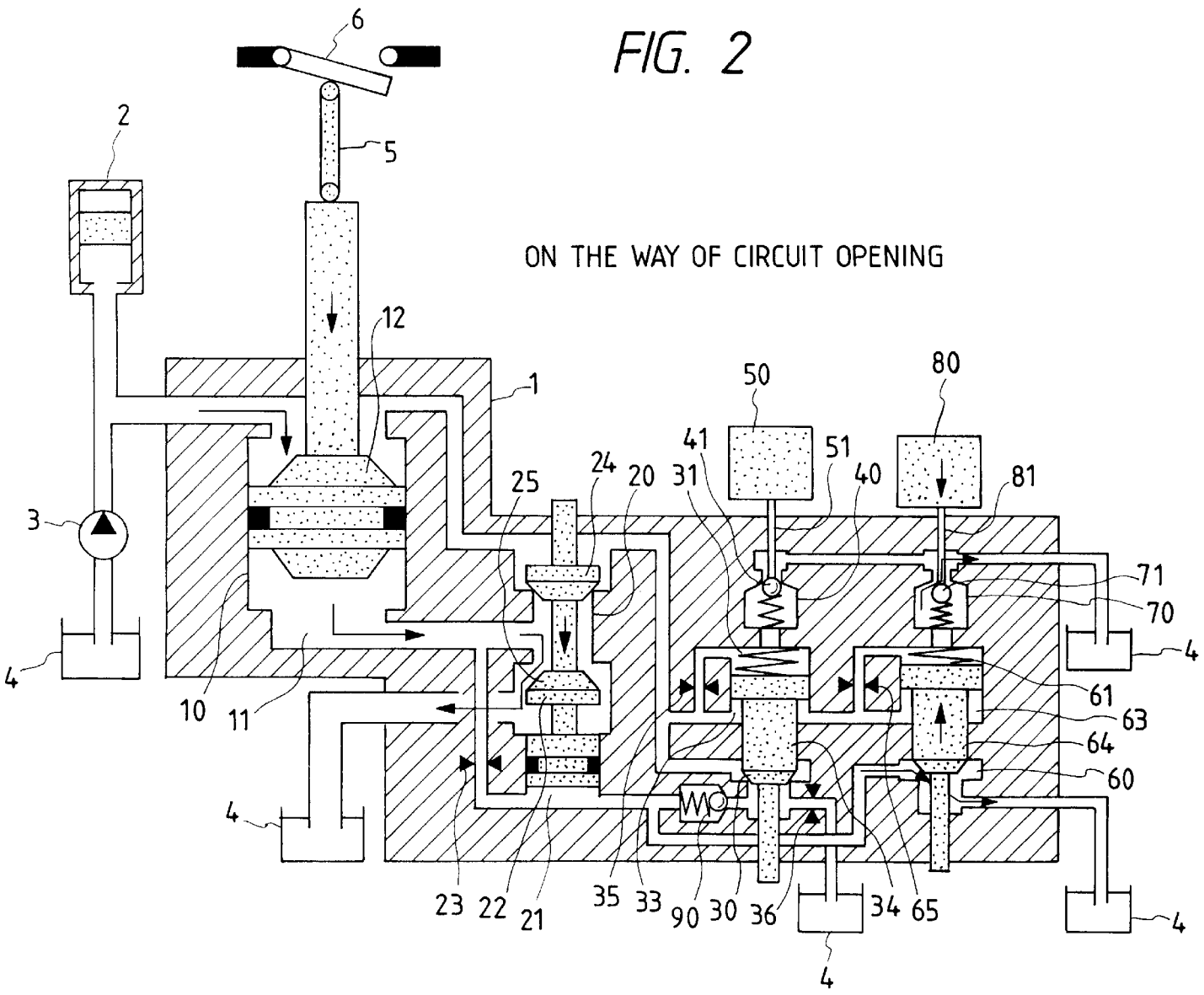
FIG. 2 is a longitudinal view depicting a liquid-pressure driving system of a gas circuit breaker on the way of circuit opening as the present example.

In FIG. 1 depicting circuit breaker part 6 at its closed-circuit state, the spool 81 of the open-circuit pilot valve driving mechanism 80 is driven downward on the input of a circuit opening command as shown in FIG. 2, to drive ball 71 of the open-circuit pilot valve 70 downward to open the valve, so that the open-circuit operation valve first pilot chamber 61 is put in the state in communication with the low-pressure oil tank 4 to be switched from a high pressure to a low pressure.

Because the open-circuit operation valve second pilot chamber 63 opposing to the open-circuit operation valve first pilot chamber 61 is at a high pressure because of the connection thereof with a high-pressure source, the open-circuit operation valve spool 64 is driven upward at such pressure difference, to put the open-circuit operation valve 60 at an open state. When the open-circuit operation valve 60 is put at its open state, the primary valve pilot chamber 21 is in communication with the low-pressure oil tank 4, so that the primary valve pilot chamber 21 is switched from a high pressure to a low pressure. Consequently, pressure difference is induced vertically in the primary valve spool 22 so that the primary valve spool 22 is driven downward to open valve 25 on the side of the open-circuit valve of the primary valve and to close valve 24 on the side of the closed-circuit valve of the primary valve. Thus, the switching chamber 11 of the liquid-pressure cylinder 10 is switched to a low pressure, so that a driving force is applied to the liquid-pressure piston 12 at vertical pressure difference to drive the liquid-pressure piston 12 downward. Consequently, the link mechanism 5 is moved downward to open the circuit breaker part 6 to effect the circuit opening motion of the circuit breaker.

Figure 3:
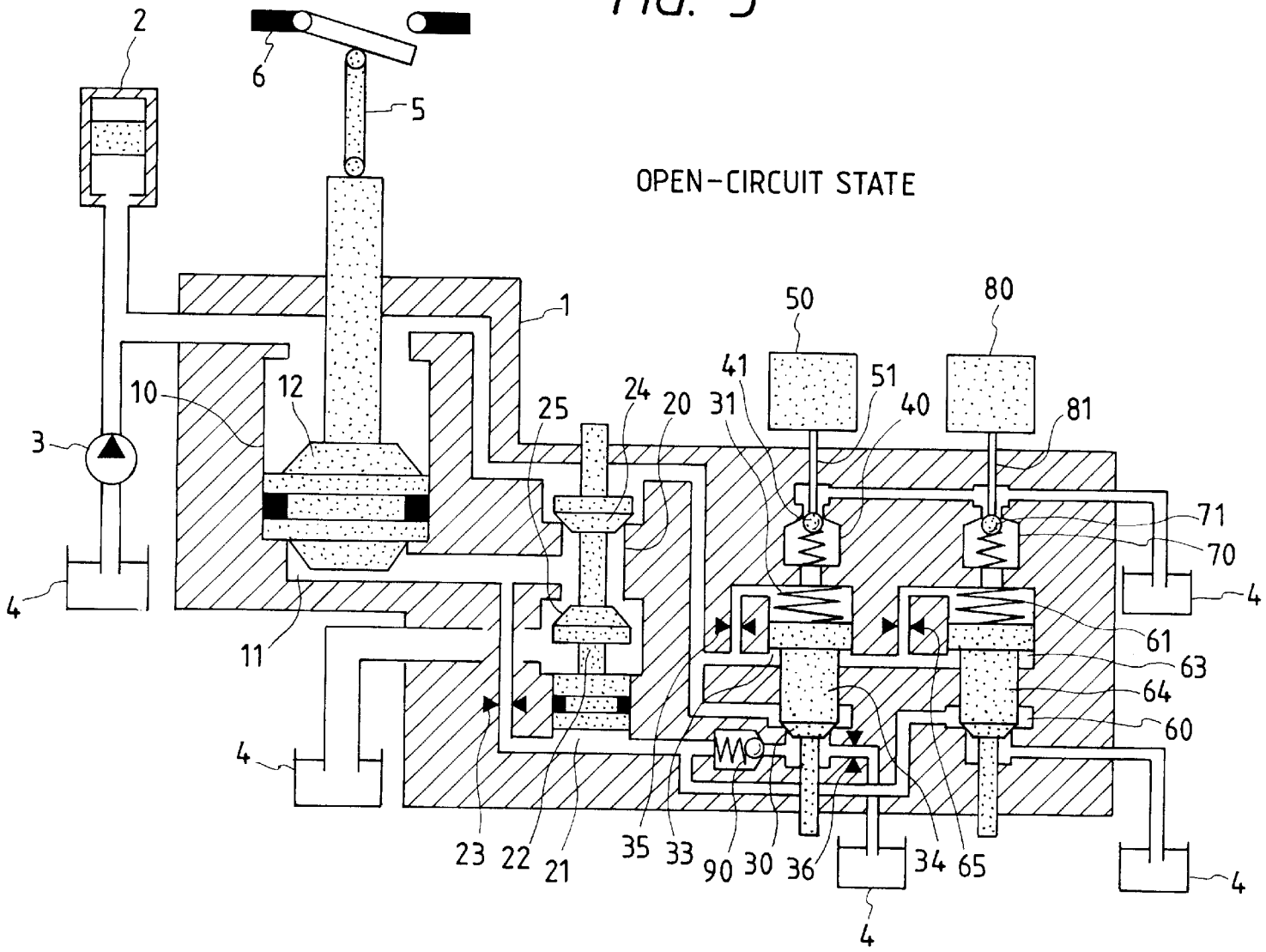
FIG. 3 is a longitudinal view depicting a liquid-pressure driving system of a gas circuit breaker at its open state as the present example.

After the completion of the primary valve operation, the open-circuit pilot valve driving mechanism 80 is electrically or mechanically reset, and so, the spool 81 of the open-circuit pilot valve driving mechanism 80 resumes its upward position. Once the spool 81 is resumed upward, the ball 71 of the open-circuit pilot valve 70 is resumed upward to close the open-circuit pilot valve 40. Because a high-pressure liquid is fed through diaphragm 65 into the open-circuit operation valve pilot chamber 61, consequently, the open-circuit operation valve spool 64 is driven downward to put the open-circuit operation valve 60 at its closed state as shown in FIG. 3. When the open-circuit operation valve 60 is put at its closed state, the communication thereof with the low-pressure oil tank 4 is broken. Because the primary valve pilot chamber 21 is in communication through diaphragm 23 with the switching chamber 11 of the liquid-pressure cylinder 10 at a low pressure state, however, the primary valve pilot chamber 21 is maintained at its low pressure state as long as the valve 24 on the side of the closed-circuit valve of the primary valve remains at its closed position and the valve 25 on the side of the open-circuit valve of the primary valve remains at its open position while the primary valve spool 22 remains at a downward position.

Figure 4:
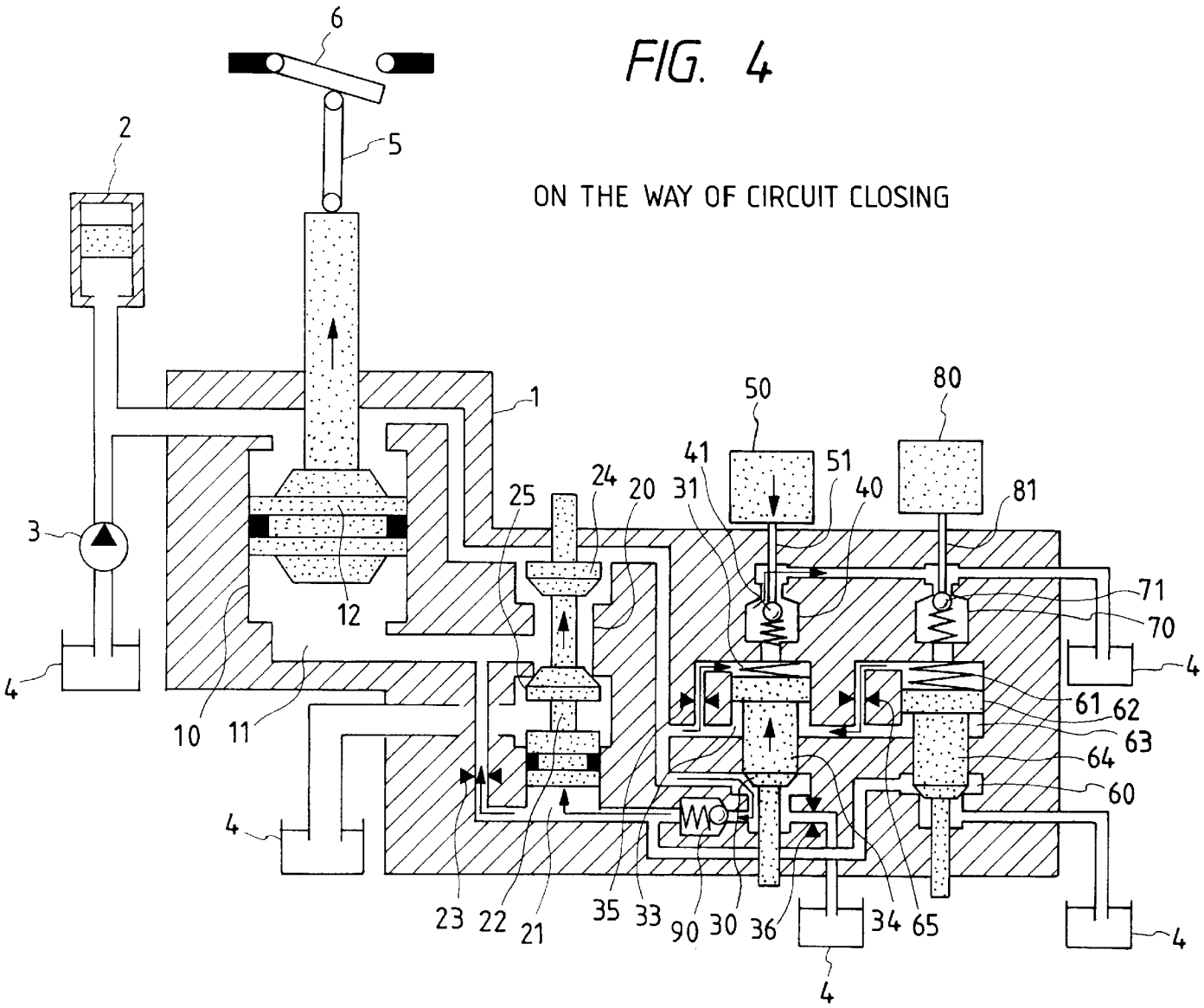
FIG. 4 is a longitudinal view depicting a liquid-pressure driving system of a gas circuit breaker on the way of circuit closing as the present example.

The spool 51 of the closed-circuit pilot valve driving mechanism is driven downward as shown in FIG. 4 once a circuit closing command is input in the state as shown in FIG. 3, so that the ball 41 of the closed-circuit pilot valve 40 is driven downward to put the closed-circuit operation valve first pilot chamber 31 in communication with the low-pressure oil tank 4 to switch the pressure from high to low levels.

Because the closed-circuit operation valve second pilot chamber 33 opposing to the closed-circuit operation valve first pilot chamber 31 is left in connection with a high-pressure source and the chamber 33 is therefore at a high pressure, a differential pressure is applied to the upward direction of the closed-circuit operation valve spool 34 to drive the closed-circuit operation valve spool 34 upward. Consequently, a high-pressure liquid is introduced through the check valve 90 into the primary valve pilot chamber 21 after the closed-circuit operation valve 30 is opened, to switch the primary valve pilot chamber 21 from a high pressure to a low pressure. The primary valve spool 22 is driven upward at the differential pressure. When the primary valve spool 22 is driven upward, the valve 24 on the side of the closed-circuit valve of the primary valve is put at its open position and the valve 25 on the side of the open-circuit valve of the primary valve is put at its closed state. Thus, the high-pressure liquid in the accumulator 22 is introduced into the switching chamber 11 of the liquid-pressure cylinder 10 to switch the pressure from a high level to a low level, to put the switching chamber 11 at a high pressure. Because the cross sectional area of the liquid-pressure piston 12 is constructed to vary, to which area the pressure of a high-pressure liquid is applied, the liquid-pressure piston 12 is driven upward, to move the link mechanism 5 upward following the liquid-pressure piston 12, to drive the circuit breaker part 6. Thus, the circuit breaker can effect its circuit closing motion.

After the completion of the primary valve operation, the closed-circuit pilot valve driving mechanism 50 is electrically or mechanically reset to drive the spool 51 of the closed-circuit pilot valve driving mechanism 50 upward to move the closed-circuit pilot valve ball 31 upward to resume its closed state to close the closed-circuit pilot valve 40. When the closed-circuit pilot valve 40 is closed to supply a high-pressure liquid through diaphragm 35 into operation valve pilot chamber 31, the open-circuit operation valve spool 34 is driven downward so that the closed-circuit operation valve 30 resumes its closed state.

Because the primary valve pilot chamber 21 is then in communication through diaphragm 23 with the switching chamber 11 of the liquid-pressure cylinder 10 and the liquid pressure acts to close the check valve 90, the high pressure can be maintained as long as the primary valve spool 22 is in the upward position while the valve 24 on the side of the closed-circuit valve of the primary valve is in the open position and the valve 25 on the side of the open-circuit valve of the primary valve is in the closed position. Alternatively, because the secondary side of the operation valve on the side of closed circuit is in communication through the diaphragm 36 with a low-pressure tank 4, the low pressure can be maintained.

As has been described above, because the discharge level of the liquid-pressure pump and the first diaphragm are set so that the discharge level Q0 and the flow Q1 of the first diaphragm might be $Q0 \geqq Q1$ at the certified lowest liquid pressure of the circuit opening motion of the gas circuit breaker when the closed-circuit pilot valve is at its open state, a pressure above the certified lowest motion pressure can be maintained even if the closed-circuit pilot valve falls into an incomplete closed state.

Even if an incomplete closed state of the pilot valve or an incomplete closed state of the closed-circuit operation valve occurs at the closed state of the circuit breaker, the liquid pressure can be maintained by the operation of the liquid-pressure pump, to effect the following circuit opening operation.

Figure 5:
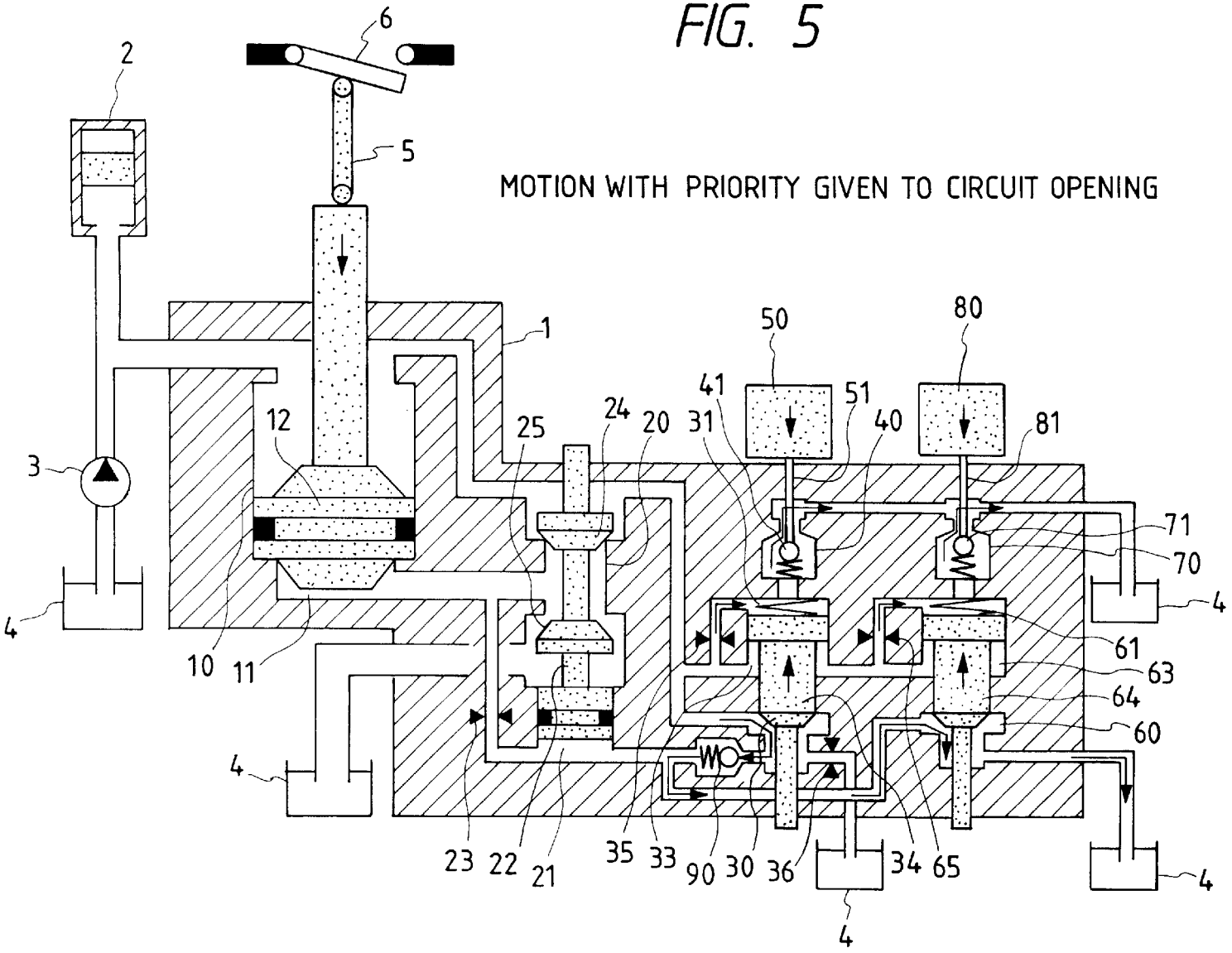
FIG. 5 is a longitudinal view depicting a liquid-pressure driving system effecting the operation with priority given to circuit opening of a gas circuit breaker of the resent example.

Then, the case of the closed-circuit pilot valve driving mechanism 50 and the open-circuit pilot valve driving mechanism 80 both in operation together will be described below. When the closed-circuit pilot valve 40 and the open-circuit pilot valve 70 are simultaneously put at open states, the closed-circuit operation valve 30 and the open-circuit operation valve 60 are simultaneously put at open states. In this case, the high-pressure liquid in the accumulator 2 is fed through the closed-circuit operation valve 30 and the check valve 90 into the primary valve pilot chamber 21, and concurrently, the high-pressure liquid fed into the primary valve pilot chamber 21 is discharged through open-circuit operation valve 60 into the low-pressure tank 4. When the closed-circuit operation valve 30 and the open-circuit operation valve are of an identical dimension, the pressure of the primary valve pilot chamber 21 is determined by the pressure loss in the feeding route of the high-pressure liquid and the pressure loss of the discharge route. Then, the dimensions of the feeding route and the discharge route are determined so that the pressure in the primary valve pilot chamber 21 is above the pressure at which the primary valve spool 22 is switched to the position of the open-circuit operation of the gas circuit breaker. By such dimensional setting, the motion with priority given to circuit opening is effected as shown in FIG. 5.

Thus, the relation between the pressure loss in the high-pressure liquid discharge route connecting between the primary valve pilot chamber and the open-circuit operation valve and the pressure loss in the high-pressure liquid supply route connecting between the closed-circuit operation valve and the primary valve pilot chamber is set as has been described above, when the closed-circuit pilot valve driving mechanism and open-circuit pilot valve driving mechanism are simultaneously driven because a circuit closing command and a circuit opening command overlap with each other, or because the closed-circuit operation valve and open-circuit operation valve are simultaneously put at their open states when the closed-circuit pilot valve and the open-circuit pilot valve are simultaneously put at their open states due to other reasons, or because the closed-circuit operation valve and the open-circuit operation valve are simultaneously put at their open states because of fixing and the like. Therefore, the primary valve pilot chamber can be put below the pressure at which the pilot chamber is switched to the open-circuit operation position.

As has been described above, the driving and resumption of the open-circuit operation valve and the closed-circuit operation valve can be conducted, on the basis of the difference in liquid pressure between the operation valve first pilot chamber and the operation valve second pilot chamber, in the present example. Therefore, a higher driving force and a greater resumption power can be attained, whereby a highly reliable operation system with higher operability can be produced.

At the closed-circuit state of the circuit breaker shown in FIG. 1, in the valve sheet sealing parts of primary valve 20, closed-circuit operation valve 30, open-circuit operation valve 60, closed-circuit pilot valve 40, open-circuit pilot valve 70 and check valve 90, the upstream of the valve sheet seals is at a higher pressure and the downstream thereof is at a lower pressure, structurally. Once an incomplete closing state of these valves occurs due to some reason during the circuit closing operation, the inner liquid may leak to cause the prolongation of the operation time of the liquid-pressure pump 3 or the increase of the operation number thereof. By monitoring the operation time or operation number of the liquid-pressure pump 3, thus, the occurrence of any incomplete closing state of the valves can be detected.

More specifically, by arranging the check valve to suppress the flow from the primary valve pilot chamber into the space on the side of the downstream of the closed-circuit operation valve and connecting the space on the side of the downstream of the closed-circuit operation valve through a second diaphragm to the low-pressure oil tank 4 to measure the operation time or operation number of the liquid-pressure pump, liquid leakage may occur because the side of the downstream of the pilot valve is at a low pressure when the pilot valve is not completely resumed, or the pilot valve is put at an incomplete closed state due to some reason such as the striking-through of foreign matters. Therefore, the operation interval of the liquid-pressure pump may be shortened or the unit operation time may be prolonged. Thus, by monitoring such operation status of these liquid-pressure pumps during normal operation, it can be detected whether or not these pilot valves may be at an incomplete closed state.

By putting the first side of the closed-circuit operation valve at a high pressure during normal operation and arranging, in between the secondary side of the closed-circuit operation valve and the check valve, a separator passage with a diaphragm, which connects with a low pressure tank, the downstream of the closed-circuit operation valve is at a low pressure. Therefore, when an incomplete closing state occurs due to not complete resumption of the closed-circuit operation valve due to fixing or the striking-through of foreign matters, liquid may leak. Therefore, any incomplete closing state of the valve can be detected by the same manner as those described above.

Because the liquid-pressure pump 3, and diaphragms 35 and 36 are individually set so that the discharge level Q0 of the liquid-pressure pump 3, the flow Q1 of the diaphragm 35 and the flow Q2 of the diaphragm 36 might satisfy the relation $Q0 \geqq Q1+Q2$ at the certified lowest operation pressure P of the circuit breaker, for example 260 $kg/cm^2G$, the certified lowest operation pressure can be maintained even if either one or both of the pilot valve on the side of the closed circuit and the operation valve on the side of the closed circuit should fail to close during the closing motion of the circuit breaker. Thus, open-circuit operation can be conducted.

Figure 6:
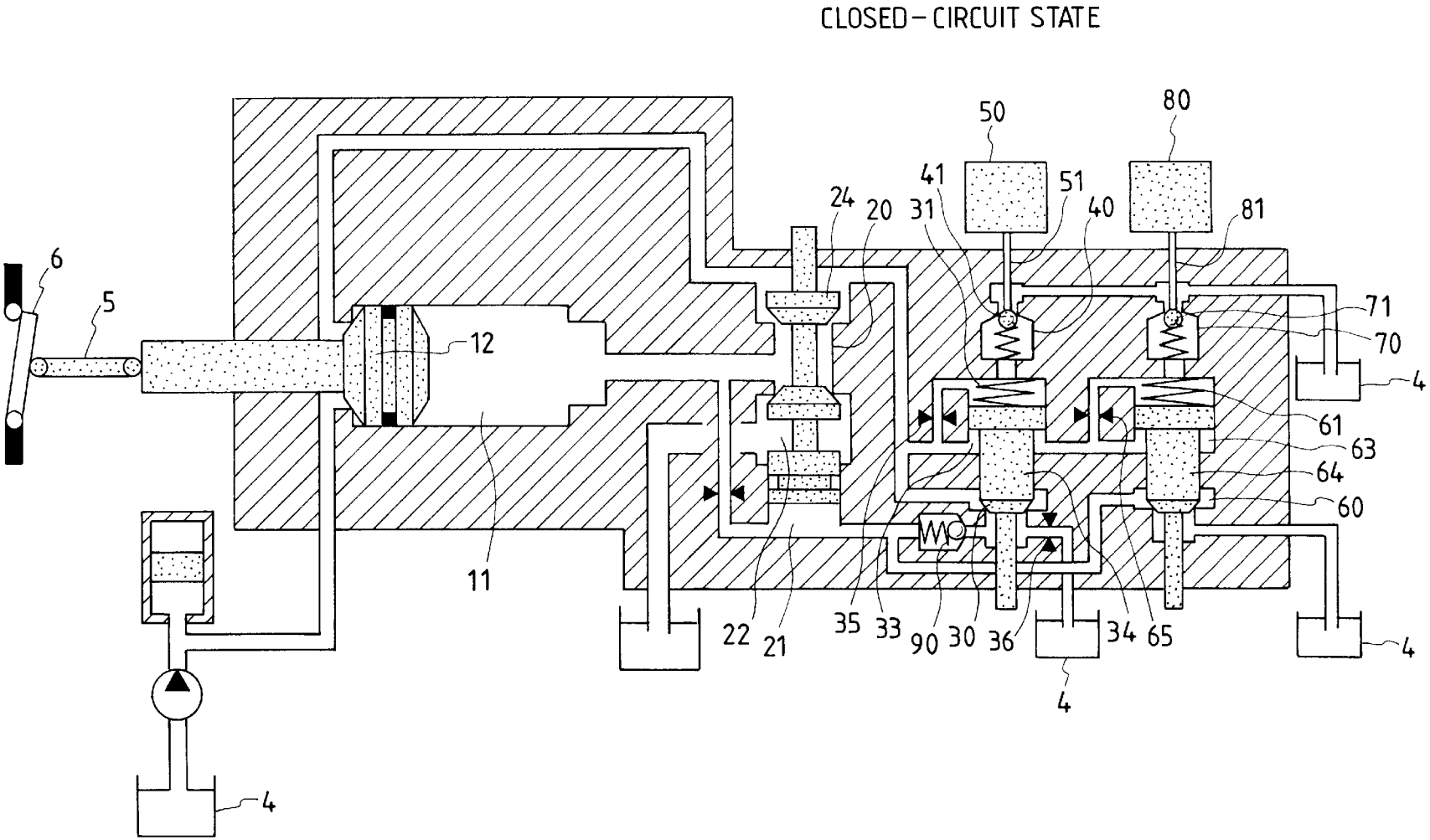
FIG. 6 is a longitudinal view depicting a liquid-pressure driving system of a gas circuit breaker at its closed state as another example of the present invention.

Description will now be made about one example in FIGS. 6 and 7, wherein vibration generated in a liquid-pressure cylinder and the like may be taken into account. FIG. 6 is a longitudinal view of a liquid-pressure driving system at the closing state of the gas circuit breaker as the example; and FIG. 7 is a view of one arrangement example of the direction of the cylinder axis of the liquid-pressure driving system of the gas circuit breaker and the direction of the motion axis of the primary valve and other valves.

When the liquid-pressure driving system is driven, generally, the maximum vibration occurs in the direction of the motion axis of the liquid-pressure cylinder. Herein, the term "operation axis" means the direction of any reciprocal motion of the cylinder. The same definition is applied to valves. In Examples of FIGS. 1 to 5, the direction of the motion axis of the liquid-pressure cylinder 10 and the direction of the motion axis of the primary valve 20, the closed-circuit operation valve 30, the closed-circuit pilot valve 40, the closed-circuit pilot valve driving mechanism 50, the open-circuit operation valve 60, the open-circuit pilot valve 70, and the open-circuit pilot valve driving mechanism 80 are coincided together, so it is highly possible that these valves may make erroneous motion at a higher vibration level during the motion of the liquid-pressure driving system. So as to prevent this, it is effective to arrange that the direction of the motion axis of the liquid-pressure cylinder and the direction of the motion axis of other valves might be vertical to each other.

Because the individual valves of the pilot valve driving system are arranged vertically to the motion axis of the liquid-pressure piston in the liquid-pressure cylinder, the closed-circuit pilot valve, the open-circuit pilot valve, the closed-circuit operation valve, the open-circuit operation valve and the primary valve may give influence of the vibration during the motion of the liquid-pressure cylinder as less as possible. Thus, the occurrence of the erroneous motion of the individual valves can be prevented.

During the motion, the primary valve 20 causes greater vibration secondarily to the liquid-pressure cylinder. Taking into account the erroneous motion of the liquid-pressure driving system due to the vibration during the motion of the primary valve 20, it is an effective arrangement that the direction of the motion axis of the closed-circuit operation valve 30, the closed-circuit pilot valve 40, the closed-circuit pilot valve driving mechanism 50, the open-circuit operation valve 60, the open-circuit pilot valve 70, and the open-circuit pilot valve driving system 80 might be vertical to the direction of the motion axis of the primary valve.

In the example shown in FIG. 7, the direction of the motion axis of the liquid-pressure cylinder 10, the direction of the motion axis of the primary valve 20, and the direction of the motion axis of other valves (namely, closed-circuit operation valve, closed-circuit pilot valve, closed-circuit pilot valve driving mechanism, open-circuit operation valve, open-circuit pilot valve and open-circuit pilot valve driving mechanism) might make an angle of 90 degrees to each other. By such arrangement, erroneous motion due to vibration during the motion can be decreased even at a greater exciting force. By such arrangement that the motion axis of the liquid-pressure piston in the liquid-pressure cylinder, the motion axis of the primary valve of the control valve system, the motion axis of the individual valves of the pilot valve driving system might be vertical to each other, the mutual influence of the mechanical vibration due to the individual motions of the liquid-pressure piston and the primary valve, can be made as less as possible, so that the occurrence of the erroneous motion of the individual valves may be prevented.

In accordance with the present invention as has been described above, the driving and resumption of the open-circuit operation valve and the closed-circuit operation valve are conducted on the basis of the difference in liquid pressure between the operation valve pilot chamber and the operation spool valve. Therefore, a higher driving force and a greater resumption power can be generated, so that a highly reliable operation system with higher operability can be produced.

Additionally, at the closed state of the circuit breaker, the valve sheet sealing parts of the primary valve, the closed-circuit operation valve, the open-circuit operation valve, the closed-circuit pilot valve, the open-circuit pilot valve and the check valve are in a construction such that the upstream of the valve sheet seals is at a high pressure and the downstream thereof is at a low pressure, so that when an incomplete closed state of the valves occurs due to some reason during the motion of circuit closing, the inner liquid may leak to prolong the operation time of the liquid-pressure pump or increase the operation number thereof. Thus, by monitoring the operation time or operation number of the liquid-pressure pump, the occurrence of an incomplete closing state of the valves can be detected.

Because the liquid-pressure pump 3, and diaphragms 35 and 36 are individually set so that the discharge level Q0 of the liquid-pressure pump 3, the flow Q1 of the diaphragm 35 and the flow Q2 of the diaphragm 36 might satisfy the relation $Q0 \geqq Q1+Q2$, the certified lowest operation pressure can be maintained even if either one or both of the pilot valve on the side of the closed circuit and the operation valve on the side of the closed circuit should fail to close during the closing motion of the circuit breaker. Thus, open-circuit operation can be conducted.

What is claimed is:

1. A gas circuit breaker comprising a breaker part, a mechanical means for the operation of break and charge of the breaker part, a liquid-pressure cylinder including a liquid-pressure piston in connection with the mechanical means, a control valve system including a primary valve to switch liquid pressure of the liquid-pressure cylinder between a low pressure and a high pressure to effect a driving operation of the liquid-pressure piston, an operation valve to switch the pressure of a primary valve pilot chamber of the primary valve between a low pressure and a high pressure to drive the primary valve, a pilot valve controlling the operation valve, a liquid-pressure source comprising a liquid-pressure pump and an accumulator for pooling an operation liquid under pressure for supply, and a pilot valve driving system for switching passage of the control valve system based on a circuit opening or closing command from the control valve system, wherein the pilot valve driving system is equipped with a closed-circuit pilot valve driving mechanism to be actuated based on the circuit closing command from the control valve system, a closed-circuit pilot valve to be opened and closed by means of the closed-circuit pilot valve driving mechanism, a closed-circuit operation first pilot chamber to be switched between a low pressure and a high pressure through the actuation of the closed-circuit pilot valve, and a closed-circuit operation valve to be driven by pressure switching of the closed-circuit operation first pilot chamber, and is also equipped with an open-circuit pilot valve driving mechanism to be actuated based on the circuit opening command from the control system, an open-circuit pilot valve to be opened and closed by means of the open-circuit pilot valve driving mechanism, an open-circuit operation first pilot chamber to be switched between a low pressure and a high pressure through actuation of the open circuit pilot valve, and an open-circuit operation valve to be driven by pressure switching of the open-circuit first pilot chamber, wherein the closed-circuit operation first pilot chamber is connected through a first diaphragm to the accumulator; and a downstream side of the closed-circuit operation valve is connected through a second diaphragm to a low-pressure oil tank, and wherein the first and second diaphragms are set so that a sum of a flow through the first diaphragm and a flow through the second diaphragm might be smaller than the discharge level of the liquid-pressure pump.

2. A gas circuit breaker comprising a breaker part, a mechanical means for the operation of break and charge of the breaker part, a liquid-pressure cylinder including a liquid-pressure piston in connection with the mechanical means, a control valve system including a primary valve to switch a liquid pressure of the liquid-pressure cylinder between a low pressure and a high pressure to effect a driving operation of the liquid-pressure piston, an operation valve to switch the pressure of a primary valve pilot chamber of the primary valve between a low pressure and a high pressure to drive the primary valve, and a pilot valve controlling the operation valve, a liquid-pressure source comprising a liquid-pressure pump and an accumulator for pooling an operation liquid under pressure for supply, and a pilot valve driving system for switching passage of the control valve system based on a circuit opening or closing command from the control valve system, wherein the pilot valve driving system is equipped with a closed-circuit pilot valve driving mechanism to be actuated based on the circuit closing command from the control valve system, a closed-circuit pilot valve to be opened and closed by means of the closed-circuit pilot valve driving mechanism, a closed-circuit operation first pilot chamber to be switched between a low pressure and a high pressure through the actuation of the closed-circuit pilot valve, and a closed-circuit operation valve to be driven by pressure switching of the closed-circuit operation first pilot chamber, and is also equipped with an open-circuit pilot valve driving mechanism to be actuated based on the circuit opening command from the control valve system, an open-circuit pilot valve to be opened and closed by means of the open-circuit pilot valve driving mechanism, an open-circuit operation first pilot chamber to be switched between a low pressure and a high pressure through actuation of the open circuit pilot valve, and an open-circuit operation valve to be driven by pressure switching of the open-circuit first pilot chamber, wherein the closed-circuit operation first pilot chamber is connected through a first diaphragm to the accumulator; and a downstream side of the closed-circuit operation valve is connected through a second diaphragm to a low-pressure oil tank, and wherein the first and second diaphragms and a discharge level of the liquid-pressure pump are set so that a pressure above a predetermined lowest operation pressure of the circuit breaker is maintained when the closed-circuit pilot valve and the closed-circuit operation valve are in open states.

3. A gas circuit breaker comprising a breaker part, a mechanical means for the operation of break and charge of the breaker part, a liquid-pressure cylinder including a liquid-pressure piston in connection with the mechanical means, a control valve system including a primary valve to switch liquid pressure of the liquid-pressure cylinder between a low pressure and a high pressure to effect driving operation of the liquid-pressure piston, an operation valve to switch pressure of the primary valve pilot chamber of the primary valve between a low pressure and a high pressure to drive the primary valve, a pilot valve controlling the operation valve, and a liquid-pressure source comprising a liquid-pressure pump and an accumulator for pooling an operation liquid under pressure for supply, and a pilot valve driving system for switching passage of the control valve system based on a circuit opening or closing command from a control system, wherein the pilot valve driving system is equipped with a closed-circuit pilot valve driving mechanism to be actuated based on the circuit closing command from the control system, a closed-circuit pilot valve to be opened and closed by means of the closed-circuit pilot valve driving mechanism, a closed-circuit operation first pilot chamber to be switched between a low pressure and a high pressure through actuation of the closed-circuit pilot valve, and a closed-circuit operation valve to be driven by pressure switching of the closed-circuit operation first pilot chamber, and is also equipped with an open-circuit pilot valve driving mechanism to be actuated based on the circuit opening command from the control system, an open-circuit pilot valve to be opened and closed by means of the open-circuit pilot valve driving mechanism, an open-circuit operation first pilot chamber to be switched between a low pressure and a high pressure through the actuation of the open-circuit pilot valve, and an open-circuit operation valve to be driven by pressure switching of the open-circuit first pilot chamber, wherein the valve sheet dimensions of the closed-circuit pilot valve and the open-circuit pilot valve and those of the closed-circuit operation valve and the open-circuit operation valve are individually of identical dimensions; the closed-circuit operation first pilot chamber and the open-circuit operation first pilot chamber are connected through a first diaphragm and a third diaphragm, respectively, to the liquid-pressure source, and a downstream side of the closed-circuit operation valve is connected through a second diaphragm to a low-pressure tank and through the valve sheet of the open-circuit operation spool valve to the low-pressure tank, and wherein resistance of passage including the first, second and third diaphragms between the liquid-pressure source and the low-pressure tank is set so that pressure in the primary valve pilot chamber positions the primary valve for the circuit opening motion of the circuit breaker when the closed-circuit pilot valve, the closed-circuit operation valve, the open-circuit pilot valve and the open-circuit operation valve are all in open states.

4. A gas circuit breaker comprising a breaker part, a mechanical means for the operation of break and charge of the breaker part, a liquid-pressure cylinder including a liquid-pressure piston in connection with the mechanical means, a control valve system including a primary valve to switch liquid pressure of the liquid-pressure cylinder between a low pressure and a high pressure to effect a driving operation of the liquid-pressure piston, an operation valve to switch pressure of a primary valve pilot chamber of the primary valve between a low pressure and a high pressure to drive the primary valve, a pilot valve controlling the operation valve, and a liquid-pressure source comprising a liquid-pressure pump for pooling an operation liquid under pressure for supply and an accumulator, and a pilot valve driving system for switching passage of the control valve system based on a circuit opening or closing command from the control system, wherein the pilot valve driving system is equipped with a closed-circuit pilot valve driving mechanism to be actuated based on the circuit closing command from the control system, a closed-circuit pilot valve to be opened and closed by means of the closed-circuit pilot valve driving mechanism, a closed-circuit operation first pilot chamber to be switched between a low pressure and a high pressure through the actuation of the closed-circuit pilot valve, and a closed-circuit operation valve to be driven by pressure switching of the closed-circuit operation first pilot chamber, and is also equipped with an open-circuit pilot valve driving mechanism to be actuated based on the circuit opening command from the control system, an open-circuit pilot valve to be opened and closed by means of the open-circuit pilot valve driving mechanism, an open-circuit operation first pilot chamber to be switched between a low pressure and a high pressure through actuation of the open circuit pilot valve, and an open-circuit operation valve to be driven by pressure switching of the open-circuit first pilot chamber, wherein a liquid-pressure source is connected through one space of a liquid-pressure cylinder to the space on the side of the closed circuit valve of the primary valve; the space on the side of the closed-circuit valve of the primary valve is connected through a first diaphragm to the closed-circuit operation first pilot chamber; a space on a side of the closed-circuit valve of the primary valve and a space of a closed-circuit operation valve spool, opposing to the closed-circuit operation first pilot chamber, are connected through a third diaphragm to an open-circuit operation first pilot chamber and a space of the open-circuit operation valve spool, opposing to the open-circuit operation first pilot chamber; a space on a downstream side of the closed-circuit operation valve and a space enclosed by the switching chamber of the liquid-pressure cylinder, the closed-circuit valve of the primary valve and the open-circuit valve of the primary valve are connected through a fourth diaphragm to the primary valve pilot chamber; the primary valve pilot chamber is connected through a check valve to the low-pressure oil tank; and a space on a downstream side of an open-circuit operation valve and a downstream side of the closed-circuit pilot and the open-circuit pilot valve are individually connected to the low-pressure oil tank.

5. A gas circuit breaker according to claim 4, wherein a discharge level of the liquid-pressure pump and the first diaphragm are set so that a discharge level Q0 and the flow Q1 of the first diaphragm is $Q0 \geqq Q1$ at a predetermined lowest liquid pressure of circuit opening motion of the gas circuit breaker when the closed-circuit pilot valve is in an open state.

6. A gas circuit breaker according to claim 4, wherein the check valve is arranged so as to suppress flow from the primary valve pilot chamber into a space on a downstream side of the closed-circuit operation spool valve, wherein the space on the downstream side of the closed-circuit operation spool valve is connected through a second diaphragm to a low-pressure oil tank and the operation time or number of times of operation of the liquid-pressure pump is measured.

7. A gas circuit breaker according to claim 4, wherein a discharge level Q0 of the liquid-pressure pump, a flow Q1 of the first diaphragm and a flow Q2 of the second diaphragm are set so as to satisfy the relation $Q0 \geqq Q1+Q2$ at a predetermined lowest operation pressure P of the circuit breaker, when the closed-circuit pilot valve is in an open state and the closed-circuit operation valve is in an open state.

8. A gas circuit breaker according to claim 4, wherein an operation axis of the closed-circuit pilot valve and the closed-circuit operation valve of the pilot valve driving system and an operation axis of the open-circuit pilot valve and the open-circuit operation valve, and an operation axis of the primary valve of the control valve system are arranged in a vertical direction to the operation axis of the liquid-pressure piston in the liquid-pressure cylinder.

9. A gas circuit breaker according to claim 4, wherein an operation axis of the liquid-pressure piston in the liquid-pressure cylinder, an operation axis of the primary valve of the control valve system, an operation axis of the closed-circuit operation valve, the closed-circuit operation valve, the open-circuit pilot valve and the open-circuit operation valve are vertical to each other.

10. A liquid-pressure driving system of a gas circuit breaker, comprising a liquid-pressure source comprising a liquid-pressure pump and an accumulator for pooling an operating liquid under pressure for supply, a liquid-pressure cylinder including a liquid-pressure piston, a primary valve equipped with a closed-circuit valve of the primary valve, an open-circuit valve of the primary valve and a primary valve pilot chamber, a closed-circuit pilot valve driving mechanism to be actuated based on a circuit closing command from a control system, a closed-circuit pilot valve to be opened and closed by means of the closed-circuit pilot valve driving mechanism, a closed-circuit operation first pilot chamber in communication with a space with the closed-circuit pilot valve arranged therein, a closed-circuit operation valve, an open-circuit pilot valve driving mechanism to be actuated based on a circuit opening command from the control system, an open-circuit pilot valve to be opened and closed by means of the open-circuit pilot valve driving mechanism, an open-circuit operation first pilot chamber in communication with a space with the open-circuit pilot valve arranged therein, and a control valve system equipped with an open-circuit operation valve, wherein the liquid-pressure source is connected through a space of the liquid-pressure cylinder to the space on the side of the closed-circuit valve of the primary valve; a space on a side of the closed-circuit valve of the primary valve is connected through a first diaphragm to the closed-circuit operation first pilot chamber; a space on a side of the closed-circuit valve of the primary valve and a space of the closed-circuit operation spool valve, opposing to the closed-circuit operation first pilot chamber, are connected through a third diaphragm to the open-circuit operation first pilot chamber; the spaces described above are connected to the space of the open-circuit operation valve, opposing to the open-circuit operation first pilot chamber; the space on the side of the downstream of the closed-circuit operation valve, the space between the switching chamber of the liquid-pressure cylinder, the closed-circuit valve of the primary valve and the open-circuit valve of the primary valve, and the switching chamber of the liquid-pressure cylinder are connected through a fourth diaphragm to the primary valve pilot chamber; the space on the side of the downstream of the primary valve pilot chamber and the closed-circuit operation valve is connected through a check valve to the space on the side of the primary valve pilot chamber and the open-circuit operation valve; a space on downstream side of the closed-circuit operation valve is connected through a second diaphragm to a low-pressure oil tank; a space on a downstream side of the open-circuit operation valve and a downstream side of the closed-circuit pilot valve and the open-circuit pilot valve are individually connected to the low-pressure oil tank, and wherein the liquid pressure of the switching chamber of the liquid-pressure cylinder is switched between a low pressure and a high pressure by switching passage of the control valve system based on the circuit closing command or a circuit opening command from the control system, to drive the liquid-pressure piston.

* * * * *